US008030854B2

(12) United States Patent
Fan Chiang et al.

(10) Patent No.: US 8,030,854 B2
(45) Date of Patent: Oct. 4, 2011

(54) WAVEFORM MANAGEMENT SYSTEMS AND METHODS FOR BALLASTS

(75) Inventors: Chih-Heng Fan Chiang, Hsinchu (TW); Hsin-Chi Chen, Hsinchu (TW)

(73) Assignee: Coretronic Corporation, Hsinchu (TW)

( * ) Notice: Subject to any disclaimer, the term of this patent is extended or adjusted under 35 U.S.C. 154(b) by 543 days.

(21) Appl. No.: 12/250,022

(22) Filed: Oct. 13, 2008

(65) Prior Publication Data

US 2009/0184670 A1 Jul. 23, 2009

(30) Foreign Application Priority Data

Jan. 22, 2008 (TW) ..... 97102355 A

(51) Int. Cl.
*H05B 37/02* (2006.01)

(52) U.S. Cl. ..... 315/291; 315/194; 315/224; 315/307

(58) Field of Classification Search ..... 315/291, 315/307, 308, 194, 195, 198, 199, 224
See application file for complete search history.

(56) References Cited

U.S. PATENT DOCUMENTS

| | | | | |
|---|---|---|---|---|
| 6,727,662 | B2 * | 4/2004 | Konopka et al. | 315/209 R |
| 7,378,807 | B2 * | 5/2008 | Feldtkeller et al. | 315/308 |
| 2007/0159107 | A1 * | 7/2007 | Powell | 315/149 |

OTHER PUBLICATIONS

Application Note USB to Ballast Control Interface, pp. 1-12, Mar. 22, 2007.*

* cited by examiner

*Primary Examiner* — David Hung Vu
(74) *Attorney, Agent, or Firm* — Thomas|Kayden

(57) ABSTRACT

Waveform management systems and methods for ballasts are provided. The system includes a lamp, a ballast, a first interface, a storage unit, and a processing unit. The processing unit obtains at least one first waveform from the storage unit, and writes the first waveform to the ballast via the first interface. The processing unit transmits an illumination signal to the ballast via the first interface, such that the ballast controls the illumination of the lamp according to the first waveform.

18 Claims, 3 Drawing Sheets

WAVEFORM MANAGEMENT SYSTEMS AND METHODS FOR BALLASTS

CROSS REFERENCE TO RELATED APPLICATIONS

This Application claims priority of Taiwan Patent Application No. 097102355, filed on Jan. 22, 2008, the entirety of which is incorporated by reference herein.

BACKGROUND OF THE INVENTION

1. Field of the Invention

The disclosure relates generally to waveform management systems and methods for ballasts, and, more particularly to systems and methods that update and check waveforms for ballasts.

2. Description of the Related Art

Generally, at least one ballast is provided in an electronic device, such as a display device or a projector, to control the illumination source in the electronic device. The ballast has at least one waveform. The illumination source may determine the timing and intensity to illumine according to the waveform. A processing unit of the electronic device, such as Scalar, may connect to the ballast via a 5-pin interface. Based on different display requirements, the processing unit may transmit an illumination signal to the ballast, thus to select a specific waveform in the ballast to control the illumination source.

In some cases, the waveforms and/or firmware in the ballast are usually needed to be updated. When the waveforms in the ballast are updated, the electronic device must be first taken apart. A host, such as a computer, is then connected to the ballast via an additional device. Then, new waveforms may be transmitted to the ballast using the host. As described, since the electronic device must be taken apart for each waveform update, it requires manual labor, is inconvenient for users, and is time consuming.

BRIEF SUMMARY OF THE INVENTION

Waveform management systems and methods for ballasts are provided.

An objective of the invention is to provide systems and methods that update waveforms for ballasts.

Another objective of the invention is to provide systems and methods that check waveforms for ballasts.

An embodiment of a waveform management system for ballasts is suitable for use in an electronic device. The system includes a lamp, a ballast, a first interface, a storage unit, and a processing unit. The processing unit obtains at least one first waveform from the storage unit, and writes the first waveform to the ballast via the first interface. The processing unit transmits an illumination signal to the ballast via the first interface, such that the ballast controls the illumination of the lamp according to the first waveform.

Another embodiment of a waveform management system for ballasts is suitable for use in an electronic device. The system includes a lamp, a ballast, a first interface, and a processing unit. The processing unit determines whether at least one second waveform in the ballast conforms to a predefined waveform. When the second waveform conforms to the predefined waveform, the processing unit transmits an illumination signal to the ballast via the first interface, such that the ballast controls the illumination of the lamp according to the second waveform.

In an embodiment of a waveform management method for ballasts for use in an electronic device, at least one first waveform is obtained from a storage unit. The first waveform is written to a ballast via a first interface. Then, an illumination signal is transmitted to the ballast via the first interface, such that the ballast controls the illumination of the lamp according to the first waveform.

In another embodiment of a waveform management method for ballasts for use in an electronic device, it is determined whether at least one second waveform in a ballast conforms to a predefined waveform. When the second waveform conforms to the predefined waveform, an illumination signal is transmitted to the ballast via the first interface, such that the ballast controls the illumination of the lamp according to the second waveform.

Waveform management systems and methods for ballasts may take the form of a program code embodied in a tangible media. When the program code is loaded into and executed by a machine, the machine becomes an apparatus for practicing the disclosed method.

Other objectives, features and advantages of the present invention will be further understood from technological features disclosed by the embodiments of the present invention. Wherein the shown and described preferred embodiments of this invention, are simply illustrations of modes best suited to carry out the invention.

BRIEF DESCRIPTION OF THE DRAWINGS

The invention will become more fully understood by referring to the following detailed description with reference to the accompanying drawings, wherein.

DETAILED DESCRIPTION OF THE INVENTION

It is to be understood that other embodiments may be utilized and structural changes may be made without departing from the scope of the present invention. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "amounted," and variations thereof herein are used broadly and encompass direct and indirect connections, couplings, and mountings.

Figure 1:
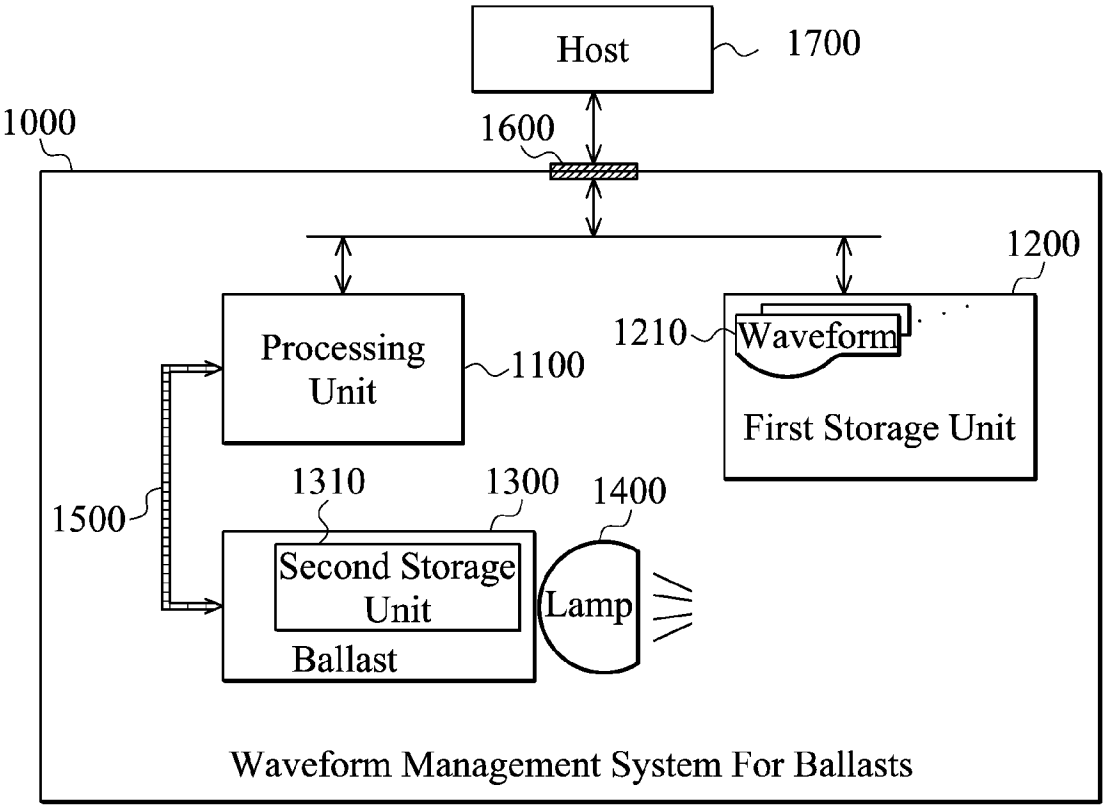
FIG. 1 is a schematic diagram illustrating an embodiment of a waveform management system for ballasts of the invention.

FIG. 1 is a schematic diagram illustrating an embodiment of a waveform management system for ballasts of the invention. The waveform management system for ballasts may be used in an electronic device, such as a display device and a projector.

As shown in FIG. 1, the waveform management system for ballasts 1000 includes a processing unit 1100, a first storage unit 1200, a ballast 1300, and a lamp 1400. In some embodiments, the first storage unit 1200 and the processing unit 1100 may be set on a main board of the electronic device. The first storage unit 1200 may be a flash memory to store at least one waveform 1210 and/or firmware (not shown) for the ballast 1300. The ballast 1300 includes a second storage unit 1310. The second storage unit 1310 may include at least one waveform (not shown). The processing unit 1100 may be a Scalar to receive image signals (not shown), and output illumination signals to the ballast 1300 via a 5-pin interface 1500. The ballast 1300 controls the illumination of the lamp 1400 according to the specific waveform in the second storage unit 1310 of the ballast 1300 in response to the direction from the processing unit 1100. Additionally, the waveform management system for ballasts 1000 further includes an external connection interface 1600. The external connection interface 1600 may be a universal serial bus (USB) interface, a recommended standard 232 (RS-232) interface, a network interface, or a video graphics array (VGA) interface. The system 1000 may connect with a host 1700, such as a computer, via the external connection interface 1600, and download waveforms and/or firmware corresponding to the ballast 1300 from the host 1700. In some embodiments, the downloaded waveforms and/or firmware corresponding to the ballast 1300 from the host 1700 may be stored in the first storage unit 1200.

Figure 2:
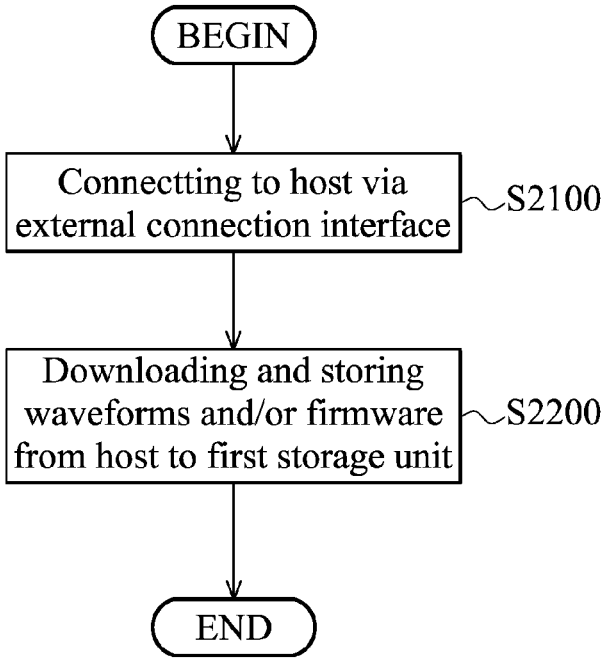
FIG. 2 is a flowchart of an embodiment of a waveform management method for ballasts of the invention.

FIG. 2 is a flowchart of an embodiment of a waveform management method for ballasts of the invention. In this embodiment, waveforms and/or firmware may be downloaded from a host via the external connection interface. In step S2100, the waveform management system for ballasts connects to a host via the external connection interface. Then, in step S2200, the waveforms and/or firmware are downloaded from the host, and are stored in the first storage unit. It is understood that, in some embodiments, the waveform management system for ballasts may have an identification code, and the system may retrieve appropriate waveforms and/or firmware via the host for download according to the identification code.

Figure 3:
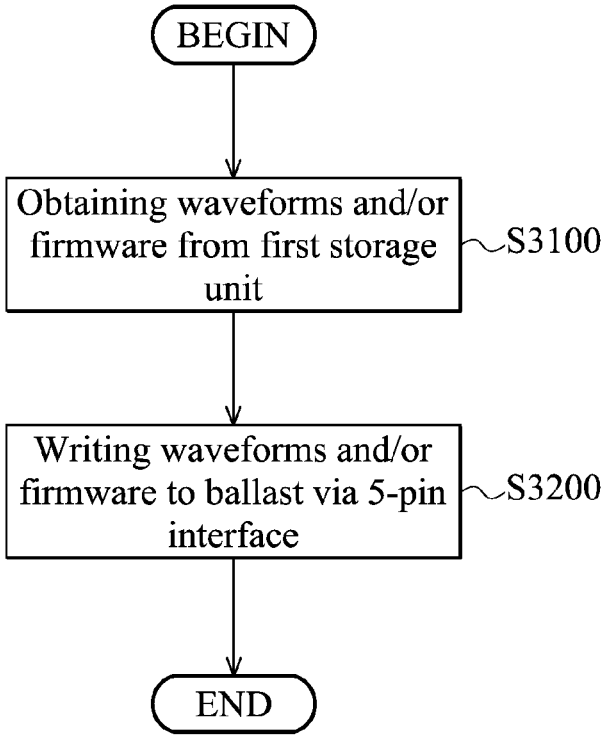
FIG. 3 is a flowchart of another embodiment of a waveform management method for ballasts of the invention.

FIG. 3 is a flowchart of another embodiment of a waveform management method for ballasts of the invention. In this embodiment, the waveforms and/or firmware in the first storage unit may be updated to the ballast via the 5-pin interface. In step S3100, the waveforms and/or firmware are obtained from the first storage unit. Then, in step S3200, the obtained waveforms and/or firmware are written to the ballast via the 5-pin interface. It is understood that, the original waveforms and/or firmware in the ballast may be replaced by the waveforms and/or firmware from the first storage unit. In some embodiments, however, the original waveforms and/or firmware in the ballast may be kept, and the waveforms and/or firmware from the first storage unit may be additionally added to the ballast. It is understood that, in some embodiments, the waveform management system for ballasts may have an identification code, to be stored in the second storage unit of the ballast or the first storage unit. The processing unit of the system may retrieve and obtain appropriate waveforms and/or firmware in the first storage unit according to the identification code. For example, in some embodiments, the processing unit may determine whether a waveform in the first storage unit is an appropriate waveform according to the identification code, thus to determine whether or not to read and obtain the waveform from the first storage unit.

Figure 4:
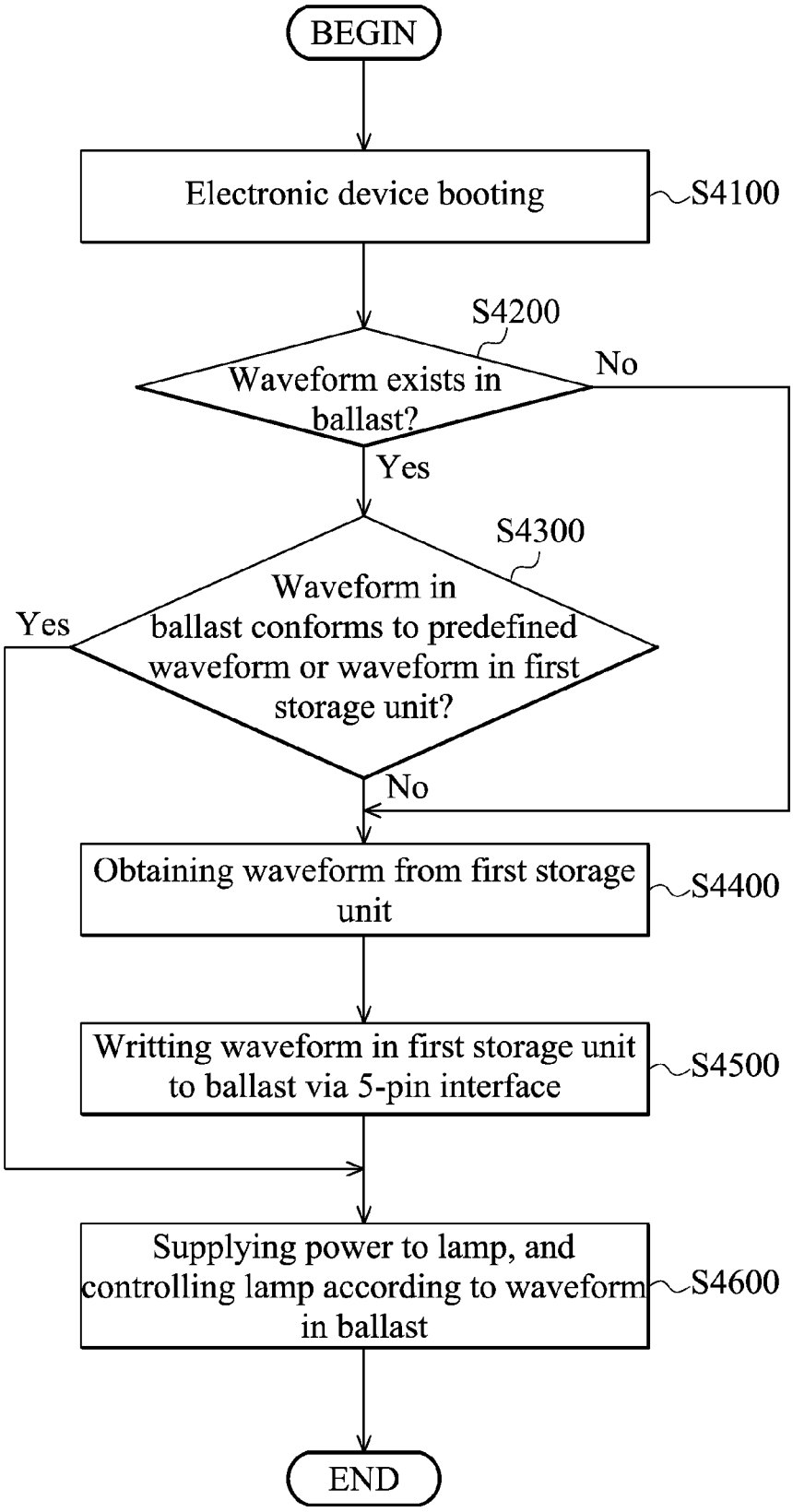
FIG. 4 is a flowchart of further another embodiment of a waveform management method for ballasts of the invention.

FIG. 4 is a flowchart of further another embodiment of a waveform management method for ballasts of the invention. In this embodiment, the waveforms in the ballast may be checked and updated.

In step S4100, the electronic device is booted up. In step S4200, it is determined whether at least one waveform exists in the ballast. If no waveform exists in the ballast (No in step S4200), the procedure goes to step S4400. If at least one waveform exists in the ballast (Yes in step S4200), in step S4300, it is determined whether the waveform in the ballast conforms to a predefined waveform and/or the waveforms in the first storage unit. It is understood that, in some embodiments, the waveforms in the first storage unit may be the predefined waveforms. If the waveform in the ballast conforms to the predefined waveform and/or the waveforms in the first storage unit (Yes in step S4300), the procedure goes to step S4600. If the waveform in the ballast does not conform to the predefined waveform and/or the waveforms in the first storage unit (No in step S4300), in step S4400, at least one waveform is obtained from the first storage unit, and in step S4500, the obtained waveform from the first storage unit is written to the ballast via the 5-pin interface. Then, in step S4600, power is supplied to the lamp, and the illumination of the lamp is controlled according to the waveform in the ballast. It is understood that, the processing unit may transmit an illumination signal to the ballast via the 5-pin interface, thus to indicate a specific waveform in the ballast, such that the ballast controls the illumination of the lamp according to the specific waveform.

Therefore, the waveform management systems and methods for ballasts of the application may check and update the waveforms of the ballast in a more easily way. Further, in some embodiments, before a waveform is written to the ballast or before a waveform in the ballast is used, the waveform may be determined whether it is an appropriate waveform according to the identification code of the system. If the waveform is an appropriate waveform, the waveform is then written to the ballast or used, to ensure that a correct waveform may be written to the ballast, thus reducing the probability of lamp burst due to incorrect waveforms.

Waveform management systems and methods for ballasts, or certain aspects or portions thereof, may take the form of a program code (i.e., executable instructions) embodied in tangible media, such as floppy diskettes, CD-ROMS, hard drives, or any other machine-readable storage medium, wherein, when the program code is loaded into and executed by a machine, such as a computer, the machine thereby becomes an apparatus for practicing the methods. The methods may also be embodied in the form of a program code transmitted over some transmission medium, such as electrical wiring or cabling, through fiber optics, or via any other form of transmission, wherein, when the program code is received and loaded into and executed by a machine, such as a computer, the machine becomes an apparatus for practicing the disclosed methods. When implemented on a general-purpose processor, the program code combines with the processor to provide a unique apparatus that operates analogously to application specific logic circuits.

The foregoing description of the preferred embodiment of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and reference to particularly preferred exemplary embodiments of the invention does not imply a limitation on the invention, and no such limitation is to be inferred. The invention is limited only by the spirit and scope of the appended claims. The abstract of the disclosure is provided to comply with the rules requiring an abstract, which will allow a searcher to quickly ascertain the subject matter of the technical disclosure of any patent issued from this disclosure. It is submitted with the understanding that it will not be used to interpret or limit the scope or meaning of the claims. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A waveform management system for ballasts for use in an electronic device, comprising:

a lamp;

a ballast;

a first interface;

a storage unit comprising at least one first waveform; and a processing unit obtaining the first waveform from the storage unit, and writing the first waveform to the ballast via the first interface, wherein the processing unit transmits an illumination signal to the ballast via the first interface, such that the ballast controls the illumination of the lamp according to the first waveform.

2. The system of claim 1, wherein the processing unit determines whether at least one second waveform in the ballast conforms to the first waveform, and when the second waveform in the ballast does not conform to the first waveform, the first waveform is written to the ballast to replace the second waveform via the first interface.

3. The system of claim 2, wherein the processing unit determines whether the second waveform conforms to the first waveform when the electronic device boots.

4. The system of claim 1, wherein the first interface comprises a 5-pin interface.

5. The system of claim 1, further comprises a second interface, wherein the first waveform in the storage unit is downloaded from a host via the second interface, and stored to the storage unit.

6. The system of claim 5, wherein the second interface comprises a universal serial bus interface, a recommended standard 232 interface, a network interface, or a video graphics array interface.

7. The system of claim 1, wherein the storage unit and the processing unit are set on a main board of the electronic device.

8. The system of claim 1, wherein the processing unit determines whether or not to read the first waveform in the storage unit according to an identification code of the system.

9. A waveform management system for ballasts for use in an electronic device, comprising:

a lamp;

a ballast comprising at least one waveform;

a first interface; and a processing unit determining whether the waveform conforms to a predefined waveform, and when the waveform conforms to the predefined waveform, transmitting an illumination signal to the ballast via the first interface, such that the ballast controls the illumination of the lamp according to the waveform.

10. The system of claim 9, wherein the processing unit determines whether the waveform conforms to the predefined waveform when the electronic device boots.

11. A waveform management method for ballasts for use in an electronic device, comprising:

obtaining at least one first waveform from a storage unit;

writing the first waveform to a ballast via a first interface; and transmitting an illumination signal to the ballast via the first interface, such that the ballast controls the illumination of a lamp according to the first waveform.

12. The method of claim 11, wherein the step of writing the first waveform to the ballast further comprises the steps of:

determining whether at least one second waveform in the ballast conforms to the first waveform; and when the second waveform in the ballast does not conform to the first waveform, writing the first waveform to the ballast to replace the second waveform via the first interface.

13. The method of claim 12, wherein the step of determining whether the second waveform conforms to the first waveform is performed when the electronic device boots.

14. The method of claim 11, wherein the first interface comprises a 5-pin interface.

15. The method of claim 11, wherein before the first waveform is obtained from the storage unit, the method further comprises a step of downloading the first waveform from a host via a second interface, and storing the first waveform to the storage unit.

16. The method of claim 15, wherein the second interface comprises a universal serial bus interface, a recommended standard 232 interface, a network interface, or a video graphics array interface.

17. The method of claim 11, wherein the storage unit is set on a main board of the electronic device.

18. The method of claim 11, wherein the step of writing the first waveform to the ballast is performed according to a result of a determination of the first waveform based on an identification code of the system.

* * * * *